United States Patent [19]

Kibby

[11] 4,419,126

[45] Dec. 6, 1983

[54] ALUMINUM PURIFICATION SYSTEM

[75] Inventor: Robert M. Kibby, Richmond, Va.

[73] Assignee: Reynolds Metals Company, Richmond, Va.

[21] Appl. No.: 161,292

[22] Filed: Jun. 20, 1980

Related U.S. Application Data

[63] Continuation-in-part of Ser. No. 7,986, Jan. 31, 1979, Pat. No. 4,216,010, which is a continuation-in-part of Ser. No. 881,786, Feb. 27, 1978, abandoned, which is a continuation-in-part of Ser. No. 785,676, Apr. 7, 1977, abandoned.

[51] Int. Cl.[3] ..... C22B 21/02

[52] U.S. Cl. ..... 75/10 R; 75/68 A

[58] Field of Search ..... 75/10 R, 68 A, 68 R

[56] References Cited

U.S. PATENT DOCUMENTS 3,929,456 12/1975 Kibby ..... 75/68 A

FOREIGN PATENT DOCUMENTS 1198294 7/1970 United Kingdom ..... 75/68 A

*Primary Examiner*—M. J. Andrews

*Attorney, Agent, or Firm*—Lyne, Girard & McDonald

[57] ABSTRACT

A method for extracting aluminum of substantial purity from furnace products resulting from carbothermic reduction of alumina-bearing ores and contaminated with up to about 30 weight percent of aluminum carbide is disclosed. The method involves contacting the furnace product with a high alumina-containing molten slag in the substantial absence of reactive carbon, so as to cause the alumina-containing slag to react with the aluminum carbide, thereby diminishing the aluminum carbide content of the furnace product to the level of 4-10% aluminum carbide by weight. It further involves heating the partially purified furnace product in the absence of both reactive carbon and slag, thereby reacting the self-contained alumina with the aluminum carbide contaminant to produce a purified aluminum.

10 Claims, 2 Drawing Figures

ALUMINUM PURIFICATION SYSTEM

CROSS-REFERENCE TO RELATED APPLICATIONS

This application is a continuation-in-part of U.S. patent application Ser. No. 7,986, filed Jan. 31, 1979, now U.S. Pat. No. 4,216,010, which is a continuation-in-part of U.S. patent application Ser. No. 881,786 now abandoned, filed Feb. 27, 1978, which in turn is a continuation-in-part of U.S. patent application Ser. No. 785,676, filed Apr. 7, 1977 now abandoned.

BACKGROUND OF THE INVENTION

This invention relates to the recovery of substantial quantities of aluminum containing no more than about 2 weight percent of aluminum carbide from furnace products resulting from the carbothermic production of aluminum.

Carbothermic processes involving the reduction of alumina-bearing ores with carbonaceous reductants have long been disclosed in the literature. Unfortunately, however, it has not been possible to obtain significant amounts of substantially pure aluminum from the vast majority of heretofore practiced operations unless special procedures were utilized.

DESCRIPTION OF THE PRIOR ART

Reference to the literature and patent art will indicate that there has been much activity by many people in an attempt to adequately define a thermal process which can compete advantageously with the conventional electrolytic methods of preparing aluminum. The art has long been aware of the many theoretical advantages which can flow from the use of a thermal operation for the production of aluminum as opposed to an electrolytic method. Unfortunately, the vast majority of carbothermic processes did not result in a significant production of aluminum in a substantially pure state.

The difficulty in producing aluminum with respect to thermal processes does not reside in the formation of the aluminum via reduction of the alumina-bearing ores, but rather, in the recovery of aluminum in a substantially pure state. The patent art, as well as the literature is full of theories and explanations with respect to various back reactions which can take place between aluminum and the various carbon-containing compounds in the feed, i.e., see U.S. Pat. No. 3,971,653.

One solution to the general problem of obtaining substantially pure aluminum from a carbothermic process is disclosed and claimed in U.S. Pat. No. 3,607,221. Although the process of this patent does result in the production of aluminum in a substantially pure state, nevertheless, extremely high operating temperatures are invovled which can lead to problems with respect to materials of construction. Another method for recovering substantially pure aluminum via a carbothermic process is disclosed and claimed in U.S. Pat. No. 3,929,456. The process of this patent also results in the production of substantially pure aluminum via a carbothermic process, but it does require careful control of the way the charge is heated in order to avoid aluminum carbide contamination.

By far, the most common technique disclosed in the prior art in attempting to produce aluminum of a high degree of purity was directed at various methods of treating the furnace product which conventionally contained 10–20 weight percent of aluminum carbide.

Thus, there are conventional techniques disclosed in the prior art, such as fluxing a furnace product with metal salts so as to diminish the amount of aluminum carbide contamination.

Unfortunately, the molten salts mixed with the carbide so removed and it is costly to remove the carbide from the salt so that the carbide can be recycled to the furnace. Without such recycle, the power consumption and furnace size becomes uneconomical in comparison with prior methods practiced commercially for making aluminum. U.S. Pat. No. 3,975,187 is directed towards a process for the treatment of carbothermically produced aluminum in order to reduce the aluminum carbide content thereof by treatment of the furnace product with a gas so as to prevent the formation of an aluminum-aluminum carbide matrix, whereby the aluminum carbide becomes readily separable from the alumina. Although the process of U.S. Pat. No. 3,975,187 is very effective in preserving the energy already invested in making the aluminum carbide, nevertheless, said process required a recycle operation with attendant energy losses associated with material handling. In one embodiment, the instant process converts the aluminum carbide to metallic aluminum, thereby completing the reduction process and minimizing energy losses. Furthermore, as pointed out at column 4, lines 31 and following, a particularly preferred embodiment of U.S. Pat. No. 3,975,187 resides in treatment of aluminum which is contaminated with no more than about 5 weight percent of aluminum carbide.

The process of parent application Ser. No. 7,986 is effective with any amount of aluminum carbide contamination greater than about 2 weight percent. However, as indicated earlier, unless special procedures are used, e.g. U.S. Pat. Nos. 3,607,221; and 3,929,456; the amount of aluminum carbide contaminant which is produced by a so-called conventional reduction furnace ranges from about 10 to about 20 weight percent.

The process of parent application Ser. No. 7,986 is directed particularly towards treatment of aluminum which is contaminated with from about 10 to about 20 weight percent of aluminum carbide which is that amount of carbide contamination which is produced by a so-called conventional carbothermic reduction furnace, but it may also be used to treat aluminum which is contaminated with from about 2 to about 10 weight percent aluminum carbide as would be produced in furnaces used primarily for the production of aluminum such as those described in U.S. Pat. Nos. 3,607,221 and 3,929,456.

The novel process of parent application Ser. No. 7,986 is carried out simply by heating the furnace product contaminated with aluminum carbide with a molten slag containing substantial proportions of alumina so as to cause the alumina in the slag to react with the aluminum carbide in the furnace product, thereby diminishing the furnace product in aluminum carbide. The expression "alumina in the slag to react with the aluminum carbide" is intended to describe various modes of reaction. While not wishing to be limited to a particular theory of operation, nevertheless, it appears that at least 2 modes of reaction as between the alumina in the slag and the aluminum carbide in the furnace product are possible.

One such mode can be described as the "reduction mode" and it involves reaction between the alumina in the slag and the aluminum carbide in the furnace product at reduction conditions so as to produce aluminum metal. One way of ascertaining operation in this mode is by the evolution of carbon monoxide.

Another such mode of reaction can be described as the "extraction mode" and it involves reaction between the alumina in the slag and the aluminum carbide in the furnace product so as to produce non-metallic slag compounds such as aluminum tetraoxycarbide, as opposed to producing liquid aluminum. Such "extraction mode" reactions occur at temperatures insufficient to cause reduction to produce additional aluminum and can occur without causing the evolution of carbon monoxide.

It is to be understood that said "extraction mode" can take place along with the "reduction mode."

In general, temperatures of at least 2050° C. are necessary for the "reduction mode" operations at reaction zone pressures of one atmosphere. At any given pressure, the temperature required for "reduction mode" operation increases as the level of aluminum carbide in the metal decreases. On the other hand, "extraction mode" operations can take place below 2050° C.

The reaction of the furnace product with the molten slag can be carried out partially or completely in the same reduction furnace which was used to prepare the metallic aluminum or the furnace product from a carbothermic reduction process can be tapped into a separate furnace containing an appropriate molten slag and the decarbonization can take place in a separate furnace. It is to be understood that this invention includes partially decarbonizing the furnace product in the furnace in which it was made followed by completing the decarbonization in a separate furnace. It is absolutely crucial in the novel process of this invention that the decarbonization reaction take place in the absence of reactive carbon. It should appear quite obvious that if reactive carbon were present during the decarbonization operation, it would have a tendency to react with the metal being decarbonized and produce more aluminum carbide thereby frustrating the novel process of Ser. No. 7,986.

Thus, for example, in those situations where the same furnace is used both to carry out the reduction of alumina-bearing ores in order to produce aluminum followed by decarbonization of the aluminum via the molten slag technique of this invention, it is absolutely crucial that the decarbonization step be carried out in the absence of reactive carbon in contact with the metal being decarbonized. In a situation just mentioned this would necessitate raising the carbon electrodes from deep immersion in the melt to a point where they barely contact the surface of the melt or are completely removed therefrom, as well as the use of a furnace which isolates any carbon lining from contact with the melt to be decarbonized, as with a non-reactive skull between a carbon lining and the furnace melt. The expression "substantial absence of reactive carbon" as used in the specification and claims is intended to mean that any reactive carbon which may be present during decarbonization is insufficient to overcome the decarbonizing reaction of aluminum carbide with alumina. Obviously, the most preferred embodiment has substantially no reactive carbon present to react with the aluminum formed in the decarbonization step. The expression "reactive carbon" means any carbon that is present during the decarbonization step (such as carbon electrodes immersed in the melt) unless special precautions have been taken to make it unavailable to react with aluminum, e.g. coating the carbon lining of a furnace shell with a non-reactive skull. The molten slags which are used in carrying out the novel process of this invention are not narrowly critical but they must possess certain characteristics in order to be useful. As has heretofore been pointed out, the molten slags are rich in alumina and in principle it might appear that pure alumina could be used but such is not preferred. In a large scale furnace, one would have to contain the molten alumina in something and in view of the fact that the melting point of pure alumina is about 2320° K., it is too close to the reaction reduction temperature which is usually around 2400° K. Thus, it is definitely preferred that the molten slag which is rich in alumina have the lowest feasible melting point. In this connection, mixtures of aluminum carbide and alumina in the range of 80–97 weight percent alumina can be employed. The preferred range of alumina in mixtures with aluminum carbide is from 85–90 weight percent.

One particularly preferred embodiment of the novel process of Ser. No. 7,986 resides in the use of slag containing calcium oxide since slags of this type have a lower melting point. It is to be understood that the majority of the slag does not have to be at the reduction temperature. It only has to be molten and at a high enough temperature to exist as a molten layer separate from the metal layer. However, the slag closest to the arc is at reduction temperature when operating in the reduction mode. It has been found, therefore, that an easier decarbonization is obtained if the slag contains sufficient calcium oxide to reduce its fusion temperature to about 1500° C. A typical slag for 1500° C. operation would contain from 0 to about 18 weight percent aluminum carbide, 40–45 weight percent calcium oxide, 0–5 percent magnesium oxide, the balance being alumina. It is to be understood, however, that lesser amounts of calcium oxide can be present in the slag, i.e. as low as 10 weight percent up to the maximum of about 55 weight percent—the balance being alumina with or without minor impurities which will in no way affect the operation of the decarbonization process. However, slags containing less than 40–45 weight percent calcium oxide will require a higher temperature to be molten.

The slags used in the process of Ser. No. 7,986 referred to as "rich in alumina" or "high alumina containing" are those wherein the weight ratio of alumina to any aluminum carbide containing therein is at least 4:1. It is also noted that the weight percentages of alumina and aluminum carbide are but a convenient and art-recognized way of expressing the aluminum, oxygen and carbon content of the slags.

DESCRIPTION OF THE PREFERRED EMBODIMENT

This invention follows the process of parent application Ser. No. 7,986, all of which is included herein by reference. However, this invention is an improvement thereupon, being based upon the discovery that when the aluminum carbide in the furnace product has been reduced to the level of 4–10%, further reaction of this remaining aluminum carbide can occur with the alumina that is dissolved, suspended, and/or occluded in the partially purified furnace product, so that further reaction with molten slag is not needed. Thus, in a continuous operation, the partially purified furnace product containing 4–10% aluminum carbide is preferably removed from the furnace that is operating in the reduction mode and sent to another furnace for additional purification. This purifying furnace must also contain no carbon that can react with the partially purified furnace product and is also operated in the reduction mode. Such dissolved, suspended, and/or occluded alumina is hereinafter referred to as "self-contained alumina."

However, it is also possible for the slag to be removed from the decarbonization furnace when the partially purified furnace product has been reduced to 4–10% $Al_4C_3$ and for purification to be completed in cyclic operation within the same furnace by reacting the self-contained alumina with the self-contained aluminum carbide at the same temperatures employed for the reduction mode when slag is present.

In effect, it has been discovered that there is a sufficient quantity of self-contained $Al_2O_3$ in a furnace product that is being purified according to the process of Ser. No. 7,986 that when its $Al_4C_3$ content has been reduced to 4–10%, the self-contained alumina functions as a "getter" to remove nearly all of the remaining aluminum carbide when simply heated in the absence of both carbon and slag.

A continuous process that is operated according to this invention therefore utilizes a reduction furnace to produce a furnace product, a decarbonization furnace to produce a partially purified furnace product containing 4–10% $Al_4C_3$, and a getter furnace to produce a relatively pure aluminum product. Of course, if the reduction furnace is equipped with a skull, if the carbon electrodes are periodically raised to eliminate substantial contact with the metal layer, and if the slag layer is periodically removed, cyclic operation within the reduction furnace itself is feasible.

Furthermore, if special procedures, as taught in U.S. Pat. Nos. 3,607,221 and 3,929,456, are used to produce a furnace product containing no more than 10% $Al_4C_3$, the furnace product can be sent directly to the getter furnace without reaction with a slag layer in a decarbonization furnace.

Operating temperatures in the getter furnace are those required for operation in the reduction mode and continue to be in inverse proportion to the level of aluminum carbide in the metal. In general, such temperatures must be well above 2050° C. in order to prevent extraction mode operations.

After the decarbonization reaction has been completed, the aluminum metal depleted in aluminum carbide can be further purified by conventional techniques, such as those disclosed in U.S. Pat. No. 3,975,187.

DESCRIPTION OF THE DRAWINGS

The drawings show furnace combinations that are based upon the process of Ser. No. 7,986 and include a getter furnace 120 for producing the improved process of this invention.

The following examples will now illustrate the best mode contemplated for carrying out the novel gettering process of this invention.

EXAMPLE 1

Figure 1:
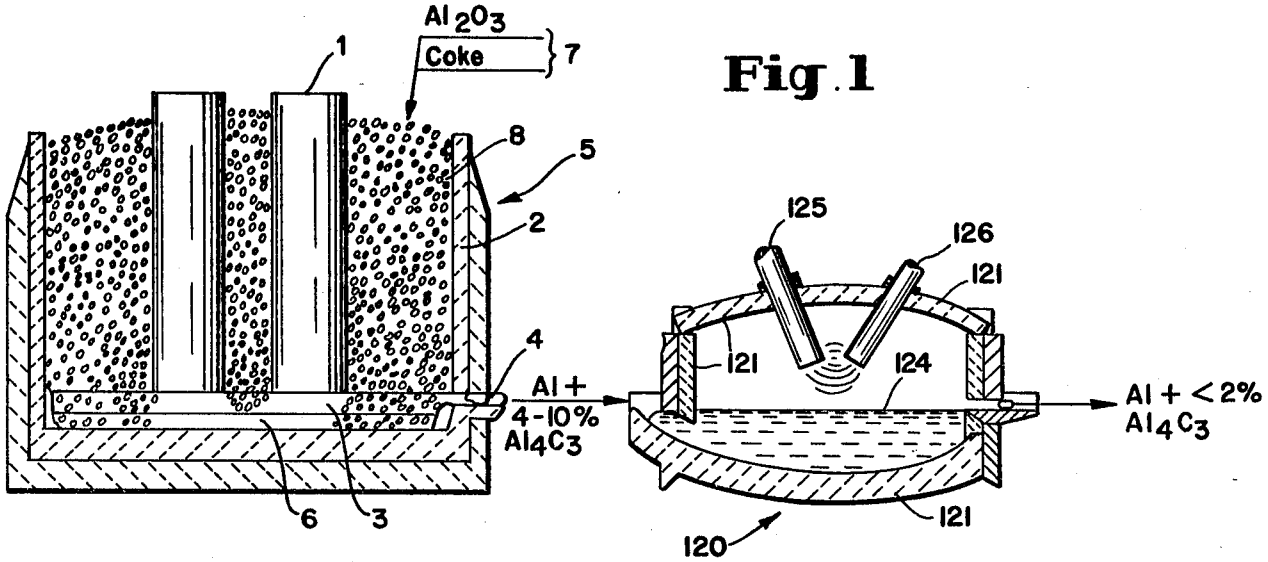
In FIG. 1, reduction furnace 5 delivers aluminum contaminated with 4–10 weight percent of aluminum carbide to getter furnace 120 wherein heat is supplied by arcs between electrodes 125,126 for further decarbonizing, by reaction of self-contained $Al_2O_3$ with self-contained (i.e., contaminating) $Al_4C_3$, to produce a purified aluminum containing less than 4% $Al_4C_3$ by weight and preferably less than 2% $Al_4C_3$. Getter furnace 120 is lined with alumina brick 121 containing no carbon.

This example will illustrate the novel process of this invention using the furnace of FIG. 1.

A charge 7 is made up in the form of briquettes having two compositions. In the preparation of the briquettes (see U.S. Pat. No. 3,723,093; column 8, lines 50–65) aluminum hydroxide powder in accordance with the Bayer method is converted to alumina powder by heating at 600°–1000° C. This alumina powder and petroleum coke powder, ground to pass 100 mesh screen, are mixed in weight ratio 85:15 for charge composition A and in weight ratio 65:35 for charge composition B. One hundred parts by weight of the well blended aggregates of each charge composition are mixed with 30 parts by weight of an organic binder, such as an aqueous 6% solution of polyvinyl alcohol. The mixtures are then compression molded into almond-shaped briquettes having a long diameter of 4 cm, using a double roll briquette machine, following which the briquettes are dried for four hours in 100°–150° C. air stream.

The starting operation to bring the furnace up to its steady condition is carried out in the following manner:

The furnace is initially heated by flow of current from electrodes 1 to a bed of crushed coke as in the practice for starting a silicon furnace. When the hearth is adequately heated according to silicon furnace practice, sufficient alumina is added to form a liquid layer 6 over the hearth. The composition of layer 6 is equivalent to a melt of alumina and aluminum carbide having alumina in the weight range 80% to 97%. The preferred range is 85% to 90% $Al_2O_3$, balance $Al_4C_3$. Then, charge of composition A is added, and electrodes 1 are pulled up to open arcs to build up liquid layer 6 to a depth of approximately 12 inches. As charge A is added and smelted to produce liquid for layer 6, additional alumina is added to maintain the weight ratio in liquid layer 6 in parts by weight ranging from 80 $Al_2O_3$/20 $Al_4C_3$ to 97 $Al_2O_3$/3 $Al_4C_3$. Only enough briquettes of composition A are added to provide the desired depth of layer 6. This is the "slag" layer. If the slag layer should become too lean in its content of $Al_4C_3$, a correction can be made by adding coke and continuing the heating under the open arc.

When the molten slag layer of desired composition has been established, the reduction charge is added to surround the electrodes to the full designed depth of charge, thus providing a charge column 8 in which vapor products can react and release heat. Normally the reduction charge is a blend of charge compositions A and B in weight proportions 42.7/57.3. Over the long range, this charge is balanced to produce aluminum containing 2% $Al_4C_3$ as hereinafter discussed. The ultimate effect of minor unbalances in the charge composition, i.e. ±5% in the proportion of $Al_2O_3$, is a change in the slag composition. So, the slag is periodically sampled and analyzed and furnace charge ratio of A to B is adjusted to bring the slag into the preferred control range set forth above.

If the slag analysis indicates a trend toward depletion of alumina, the ratio of A to B is increased. If the slag analysis indicates a trend toward depletion of $Al_4C_3$, the ratio of A to B is decreased.

As reduction proceeds, aluminum containing from 10 to 20% $Al_4C_3$ is formed and rests as a separate liquid layer over the slag layer. At the same time, some aluminum vapor and aluminum monoxide ($Al_2O$) gas is produced. These mix with the CO formed by the aluminum producing reaction and pass upwardly through the charge column 8, where back reactions occur, releasing heat and producing compounds which recycle down with the charge to produce aluminum. The heat released in column 8 is used to pre-heat charge and to provide heat to cause charge A to produce $Al_4O_4C$. At a higher temperature closer to the arc, charge composition B reacts to produce $Al_4C_3$. Finally the $Al_4C_3$ and $Al_4O_4C$ produced in the charge column 8 receive heat from the arc and produce aluminum containing from 10–20% $Al_4C_3$ and the vapor products previously discussed.

The heat intensity reaching the charge from the arc must be limited, otherwise the vaporization rates will be so great that pre-heat and pre-reduction reactions in charge column 8 cannot absorb the back reaction heat. Under these conditions the furnace is thermally unstable, and unreacted vapor products will blow out the top of the charge, releasing excessive heat and wasting valuable reactants. The tailoring of furnace and electrode dimensions in relation to heat release by the arc to avoid such thermal instabilities is known by those skilled in the art of electric furnace design.

The proper level (intensity) of arc heat for thermally stable reduction and its related current and voltage values for a particular furnace capacity will be called level X.

To convert the reduction product containing from 15 to 20% carbide to a product containing about 4–10% carbide, a second mode of operation is periodically employed where the heat level Y is substantially less than level X, i.e., from 10 to 50% of level X, but in any event low enough that no further reduction of the charge from column 8 occurs. Heat level Y is applied by open arc to the surface of the melt resting on the hearth of the furnace. Under these conditions, the aluminum carbide contained in the metal layer reacts with the alumina contained in the slag layer and such alumina as may be contained in the metal layer to produce more liquid aluminum and CO and a minor amount of aluminum vapor and $Al_2O$ gas. The carbide level in the metal layer is reduced thereby to about 4%–10%, and the vapors pass up through the charge column to back react and release heat as under reduction conditions.

The degree of decarbonization in this mode of furnace operation can be judged by the fluidity of the metal layer or by a simple known chemical analysis.

Before the furnace is returned to heat level X necessary for further reduction of charge, the furnace is tilted to pour out decarbonized aluminum containing about 4%–10% carbide, and any surplus slag that may have been produced because of corrections to slag composition previously mentioned. The two layers of melt 3 and slag 6 are mutually immiscible at these conditions, so the aluminum layer 3 pours off first, followed by some slag from layer 6.

Aluminum containing from 4 to 10% $Al_4C_3$ and about 12% $Al_2O_3$ is transferred to furnace 120 where it is heated further by heat radiated from open arcs between electrodes 125 and 126. In furnace 120, the self-contained alumina in the metal transferred from furnace 5 reacts with the $Al_4C_3$ contaminating the metal transferred from furnace 5 to produce more aluminum and CO. No molten slag is present in furnace 120 except for that which is inadvertently tapped from furnace 5. This slag tends to freeze and accumulate on the non-carbonaceous lining of furnace 120, and periodically is cleaned out by heating the bottom, without metal being present, until enough bottom has become molten to permit restoration of the desired lining level by pouring the excess high-alumina lining material out.

Metal containing from 2 to 4% aluminum carbide is transferred from getter furnace 120 to a holding furnace where it is fluxed with tri-gas by known practice to produce commercially pure aluminum, i.e., the processes of U.S. Pat. No. 3,975,187.

Excess slag and skim from the fluxing furnace are cooled to ambient temperature and returned to the charge preparation operation.

EXAMPLE 2

Figure 2:
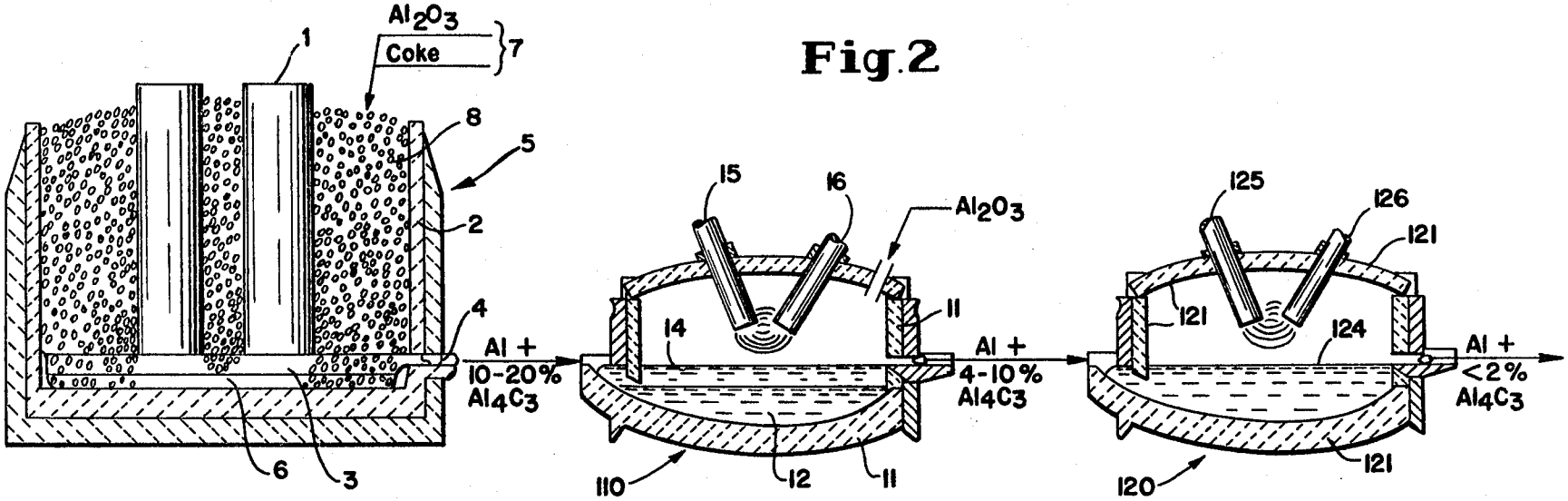
In FIG. 2, reduction furnace 5 delivers aluminum contaminated with 10–20 weight percent of aluminum carbide to decarbonization furnace 110 wherein decarbonizing heat is supplied by acrs between electrodes 15,16 to aluminum layer 14, overlying and reacting with molten slag layer 12. The product of furnace 110, containing 4–10% $Al_4C_3$ by weight and about 12% by weight of $Al_2O_3$, is tapped and sent to getter furnace 120 to be treated as described in connection with FIG. 2.

The furnace construction, startup procedure and charge preparation are the same as in Example 1. The difference is that the furnace 5 operates continuously in reduction mode at heat level X, as described in Example 1, and the metal layer containing from 10–20% carbide is tapped periodically to a second furnace 110 where decarbonization occurs. This system is illustrated in FIG. 2.

Furnace 110 is an electric furnace, typically used for the melting of iron or steel. The lining 11 is of high alumina brick and contains no carbon. Slag 12 is controlled by addition of alumina to maintain a composition equivalent to a weight ratio of alumina to aluminum carbide in the range of 80–97% alumina, balance $Al_4C_3$, and preferably in the range of 85% to 90% $Al_2O_3$, balance $Al_4C_3$. Aluminum containing from 10 to 20% $Al_4C_3$ is periodically transferred from furnace 5 to furnace 110. Any surplus slag in furnace 5 is also transferred to furnace 110. Heat from open arcs from electrodes 15 and 16 cause the $Al_4C_3$ in the metal layer 14 to react with $Al_2O_3$ in the slag layer and such alumina as may be in the metal layer to produce aluminum, CO, and a minor amount of Al vapor and $Al_2O$ gas. These gases are oxidized by contact with air in the furnace to produce $Al_2O_3$ and $CO_2$, and cooled to separate the particulates which are returned to the reduction charge preparation area.

Aluminum containing from 4 to 10% $Al_4C_3$ and about 12% $Al_2O_3$ is transferred from furnace 110 to furnace 120 where it is heated further by heat radiated from open arcs between electrodes 125 and 126. In furnace 120, the self-contained alumina in the metal transferred from furnace 110 reacts with the $Al_4C_3$ contaminating the metal transferred from furnace 110 to produce more aluminum and CO. No molten slag is present in furnace 120 except for that which is inadvertently tapped from furnace 110. This slag tends to freeze and accumulate on the non-carbonaceous lining of furnace 120, and periodically is cleaned out by heating the bottom, without metal being present, until enough bottom has become molten to permit restoration of the desired lining level by pouring the excess high-alumina lining material out.

Metal containing from 2 to 4% aluminum carbide is tapped to a holding furnace where fluxing with tri-gas according to known practice, i.e., U.S. Pat. No.

3,975,187, converts the metal layer to commercially pure aluminum.

Following each metal tap from furnace 10, alumina is added to slag 12 to restore the $Al_2O_3/Al_4C_3$ ratio to the preferred control range cited above.

The advantage of the method and apparatus of this example over the single furnace apparatus of Example 15 is that more positive steps are taken through apparatus arrangement to provide conditions for decarbonization. The apparatus of this example positively excludes the possibility of contact of reactive carbon with the melt being decarbonized.

What is claimed is:

1. A process for decreasing aluminum carbide contamination of aluminum produced by carbothermic processes, said process comprising:

A. preparing said aluminum contaminated with about 10–20 weight percent aluminum carbide as a melt at an initial temperature sufficiently high to keep said melt in a fluid state;

B. contacting said melt with a high-alumina containing molten slag in the absence of reactive carbon so as to cause the alumina-containing slag to react with the aluminum carbide in said melt until a partially purified aluminum containing 4–10% aluminum carbide is produced;

C. continuing to heat said partially purified aluminum in the absence of both said carbon and said slag to produce a purified aluminum containing less than 4% aluminum carbide by weight; and D. recovering said purified aluminum.

2. A process for decreasing aluminum carbide contamination of aluminum produced by carbothermic processes, said process comprising:

A. preparing said aluminum contaminated with about 4–10 weight percent aluminum carbide as a melt in the absence of reactive carbon at an initial temperature sufficiently high to keep said melt in a fluid state;

B. continuing to heat said contaminated aluminum in the absence of said carbon and in the absence of slag to produce a purified aluminum containing less than 4% aluminum carbide by weight by reacting self-contained alumina with said aluminum carbide; and C. recovering said purified aluminum.

3. The process of claim 1 wherein the high-alumina containing molten slag comprises 80–97 weight percent alumina, balance aluminum carbide.

4. The process of claim 3 wherein the slag comprises 85–90 weight percent alumina.

5. The process of claim 1 wherein the high-alumina containing molten slag comprises:

| | |
|---|---|
| CaO | 10–55 weight percent |
| MgO | 0–5 weight percent |
| $Al_4C_3$ | 0–18 weight percent |
| Balance Alumina. | |

6. The process of claim 5 wherein the calcium oxide comprises 40–45 weight percent.

7. The process of claim 6 wherein said high-alumina containing molten slag melts at about 1500°–1900° C.

8. The process of claim 5 wherein in step (B) a relatively pure aluminum is separated prior to contact with said slag at reduction temperatures.

9. The process of claim 1 wherein said purified aluminum contains less than 2% aluminum carbide by weight.

10. The process of claim 2 wherein said purified aluminum contains less than 2% aluminium carbide by weight.

* * * * *